US006050336A

United States Patent [19]

Willauer et al.

[11] Patent Number: 6,050,336

[45] Date of Patent: Apr. 18, 2000

[54] METHOD AND APPARATUS TO ISOLATE A SPECIFIC ZONE

[75] Inventors: Darrin L. Willauer, The Woodlands; Rustom K. Mody, Bellaire; Greg Badke, Conroe; Mark Plante, Houston, all of Tex.

[73] Assignee: Baker Hughes Incorporated, Houston, Tex.

[21] Appl. No.: 08/957,235

[22] Filed: Oct. 24, 1997

Related U.S. Application Data

[60] Provisional application No. 60/029,311, Oct. 25, 1996.

[51] Int. Cl.[7] ..... E21B 33/134

[52] U.S. Cl. ..... 166/286; 166/117; 166/153; 166/192; 166/387

[58] Field of Search ..... 166/117, 153, 166/162, 177.4, 177.5, 192, 281, 285, 286, 292, 386, 387

[56] References Cited

U.S. PATENT DOCUMENTS

| | | | |
|---|---|---|---|
| 1,639,079 | 8/1927 | Cushing | 166/192 |
| 1,934,701 | 11/1933 | Edwards et al. | 166/286 |
| 2,618,344 | 11/1952 | Turechek et al. . | |
| 2,942,666 | 6/1960 | True et al. . | |
| 3,064,734 | 11/1962 | Toelke | 166/63 |
| 3,301,329 | 1/1967 | Martin . | |
| 3,422,897 | 1/1969 | Conrad . | |
| 3,460,618 | 8/1969 | Blagg . | |
| 3,572,433 | 3/1971 | Conrad . | |
| 3,578,083 | 5/1971 | Anderson et al. | 166/285 |
| 3,706,342 | 12/1972 | Woolley . | |
| 3,872,925 | 3/1975 | Owen et al. | 166/286 |
| 4,339,000 | 7/1982 | Cronmiller | 166/295 |
| 4,423,783 | 1/1984 | Haag | 166/382 |
| 4,491,178 | 1/1985 | Terrel et al. | 166/192 |
| 4,545,433 | 10/1985 | Wambaugh | 166/387 X |
| 4,739,652 | 4/1988 | Kovari et al. | 166/382 X |
| 4,953,617 | 9/1990 | Ross et al. | 166/192 X |
| 5,417,285 | 5/1995 | Van Buskirk et al. | 166/292 |
| 5,479,986 | 1/1996 | Gano et al. | 166/292 |
| 5,622,453 | 4/1997 | Finley et al. | 166/292 X |
| 5,623,993 | 4/1997 | Van Buskirk et al. | 166/292 |
| 5,685,372 | 11/1997 | Gano | 166/292 |
| 5,755,286 | 5/1998 | Ebinger | 166/281 |

FOREIGN PATENT DOCUMENTS

| | | |
|---|---|---|
| 41 22 811 A1 | 7/1991 | Germany . |
| 2 248 255 | 4/1992 | United Kingdom . |

*Primary Examiner*—George Suchfield
*Attorney, Agent, or Firm*—Duane, Morris & Heckscher LLP

[57] ABSTRACT

A method and apparatus are disclosed which allow isolation of a plurality of zones for treatment, particularly sand fracturing. The lowermost barrier can be pumped through tubing and anchored in cased or open holes. In the preferred embodiment, the pumped plug has a visco-elastic member which contains a particulate aggregate mixture, such as described in U.S. Pat. No. 5,417,285. The visco-elastic material is subjected to a force which changes its shape so that the material obstructs the wellbore. The shape change also accomplishes dehydration of the material within the visco-elastic enclosure by virtue of fluid displacement, resulting from a volume reduction, hardening it so that a plug using the visco-elastic material is formed. Thereafter, a packer on the tubing string is set to isolate the zone for sand fracturing. The process can be repeated without tripping out of the hole as additional plugs are pumped through tubing and the process is repeated. At the conclusion of the fracturing, the various plugs, which are of simple and economical construction, can be readily milled out.

19 Claims, 7 Drawing Sheets

METHOD AND APPARATUS TO ISOLATE A SPECIFIC ZONE

This application claims the benefit of U.S. provisional application Ser. No. 60/029,311 filed Oct. 25, 1996.

FIELD OF THE INVENTION

The field of this invention relates to zone isolation in a wellbore, particularly involving applications of sand fracturing.

BACKGROUND OF THE INVENTION

In order to stimulate production from a wellbore, fracturing techniques have been employed. One such technique involves sand fracturing, where sand carried by a fluid, delivered at high flow rates and pressures, is squeezed into the formation. In accomplishing the fracturing, a specific zone is isolated.

Other procedures for stimulating production also call for pumping fluids into a specific zone in a wellbore. One such procedure is acidizing. Equipment has been developed for simple isolation for injection of acid or chemicals. One such tool is a selective stimulation tool, Product No. 350-01, made by Baker Oil Tools. This tool can be run through production tubing and set in the wellbore below to perform selective treatment operations. However, when attempting a sand fracturing, such tools are not equipped to handle the erosive effects of high fluid velocities or volumes with entrained sand. Accordingly, such tools are generally used for clear fluids without suspended solids, involving significantly lower flow rates than are involved in sand fracturing.

Another technique for accomplishing sand fracturing, particularly if there are multiple zones in a wellbore to be isolated and fractured, is to set a lower plug, then trip out of the hole and run in a string with a packer. The packer on the string is then set and the sand fracturing occurs in the isolated zone. Thereafter, the string and packer are pulled out of the hole and another plug is run-in at a higher elevation in the wellbore, and the process is repeated for the next subsequent zone. This process is considerably time-consuming and, therefore, generates considerable expense because of such delays.

Another technique, having limited usefulness to vertical wellbores, involves setting a plug in the wellbore and then pumping sand above the set plug until the appropriate zone is reached. A string is then run-in with a packer to close off the upper portion of the zone to be fractured. Sand fracturing then proceeds. The next zone is reached by pumping in more sand through the string until a sufficient amount of sand has been deposited to reach the lower end of the next zone to be fractured. The string is positioned with a packer and the packer set on the string to, again, close off the remainder of the wellbore uphole, and the process is repeated. If there's any deviation to the wellbore, which is now a fairly common technique, then this method is unworkable in that the deposited sand on the bottom of the plug does not fully fill up the wellbore for isolation when the zone is fractured.

Even the technique that involves placement of a series of plugs has an undesirable feature in that costs quickly escalate the more zones are to be isolated for sand fracturing. Typical plugs that have been used in the past could cost as much as US$10,000–$15,000. Thus, if multiple zones are to be isolated for sand fracturing, the cost can be prohibitive. Additionally, the plugs will have to be milled out, which involves an additional expense in that traditionally used plugs, having numerous metallic components, will take time before they are fully ground up.

Other wellbore sealing techniques, involving deposition of particulate matter involving an aggregate mixture, have been disclosed. One such application is illustrated in U.S. Pat. No. 5,417,285, issued May 23, 1995, and assigned to Baker Hughes Incorporated. This patent illustrates the use of a particulate plug above an inflatable packer for isolation of a portion of the wellbore. A particular aggregation of particulate matter is described that, when subjected to pressure and at least partially dehydrated, forms an impervious barrier. The disclosure of U.S. Pat. No. 5,417,285 is incorporated herein by reference as if fully set forth.

One of the objects of the present invention is to provide the ability to quickly and economically sand-fracture multiple zones in a wellbore, regardless of whether the wellbore is vertical or horizontal. It is another object of the invention to use an aggregate mixture of particulate material, as, for example, defined in U.S. Pat. No. 5,417,285, for a part of the actuation of downhole packers or plugs. It is a further object of the invention to run a packer or packers or plugs into the wellbore, holding within a particulate aggregate material, and dehydrate the material downhole, in conjunction with actuating the plug or packer, to create a barrier in the wellbore.

SUMMARY OF THE INVENTION

A method and apparatus are disclosed which allow isolation of a plurality of zones for treatment, particularly sand fracturing. The lowermost barrier can be pumped through tubing and anchored in cased or open holes. In the preferred embodiment, the pumped plug has a visco-elastic member which contains a particulate aggregate mixture, such as described in U.S. Pat. No. 5,417,285. The visco-elastic material is subjected to a force which changes its shape so that the material obstructs the wellbore. The shape change also accomplishes dehydration of the material within the visco-elastic enclosure by virtue of fluid displacement, resulting from a volume reduction, hardening it so that a plug using the visco-elastic material is formed. Thereafter, a packer on the tubing string is set to isolate the zone for sand fracturing. The process can be repeated without tripping out of the hole as additional plugs are pumped through tubing and the process is repeated. At the conclusion of the fracturing, the various plugs, which are of simple and economical construction, can be readily milled out.

DETAILED DESCRIPTION OF THE PREFERRED EMBODIMENT

Figure 1:
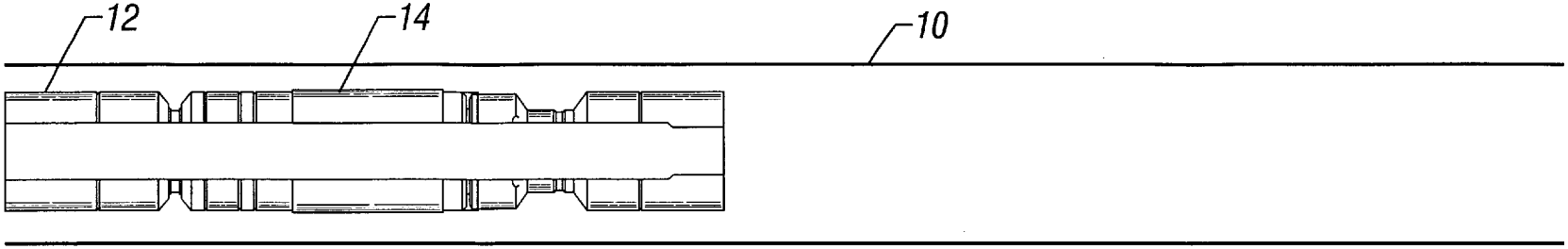
FIG. 1 is a sectional elevational view illustrating positioning of the tool string in the wellbore.
Figure 2:
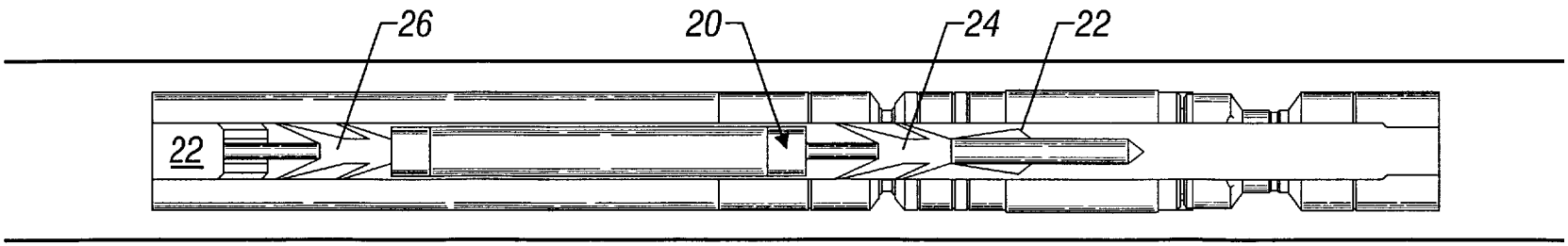
FIG. 2 is the view of FIG. 1, showing the bridge plug being pumped down through the tool string.
Figure 3:
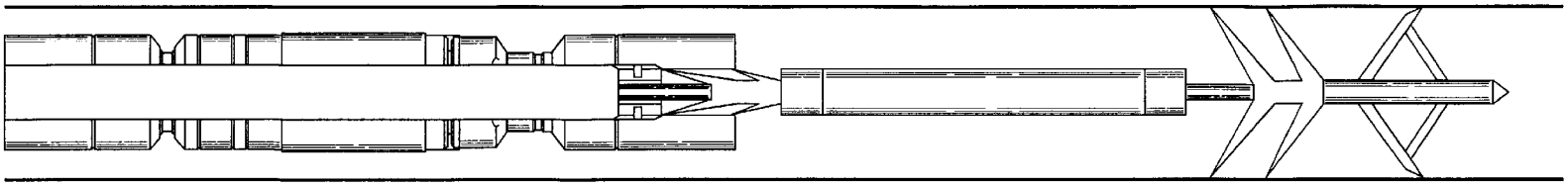
FIG. 3 is the view of FIG. 2, with the anchor set on the bridge plug.
Figure 4:
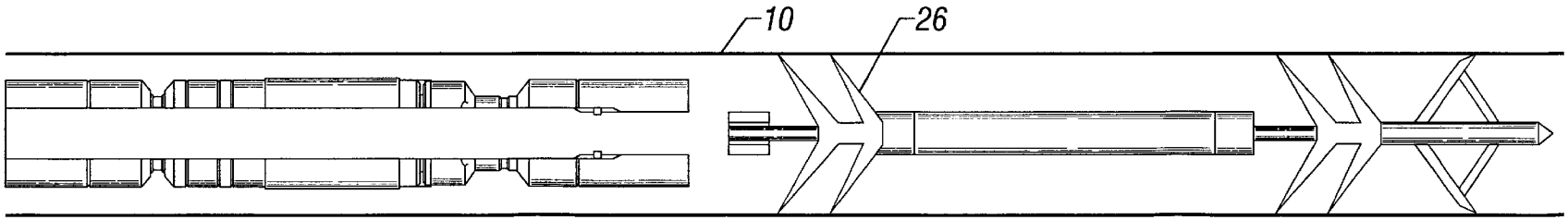
FIG. 4 is the view of FIG. 3, with the bridge plug released from the tool string.
Figure 5:
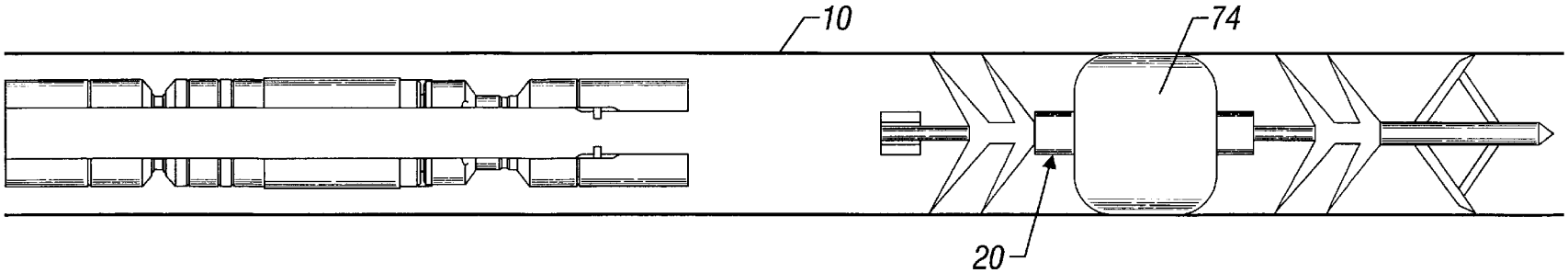
FIG. 5 is the view of FIG. 4, with the bridge plug set.
Figure 6:
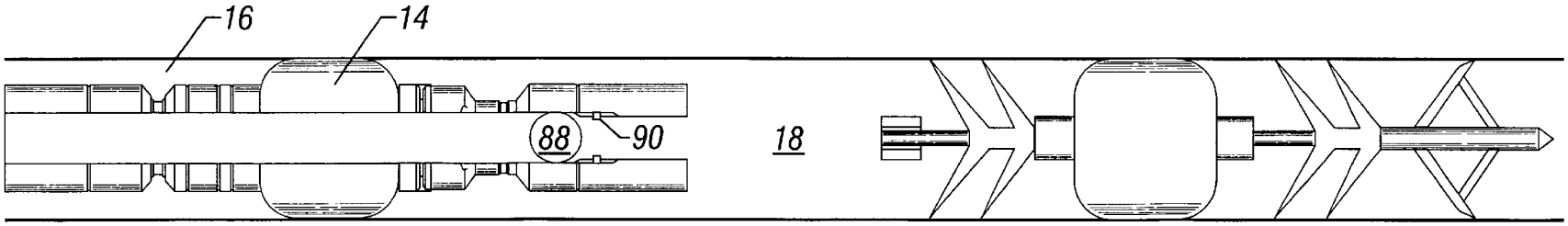
FIG. 6 is the view of FIG. 5, with the packer on the tool string set.
Figure 9A:
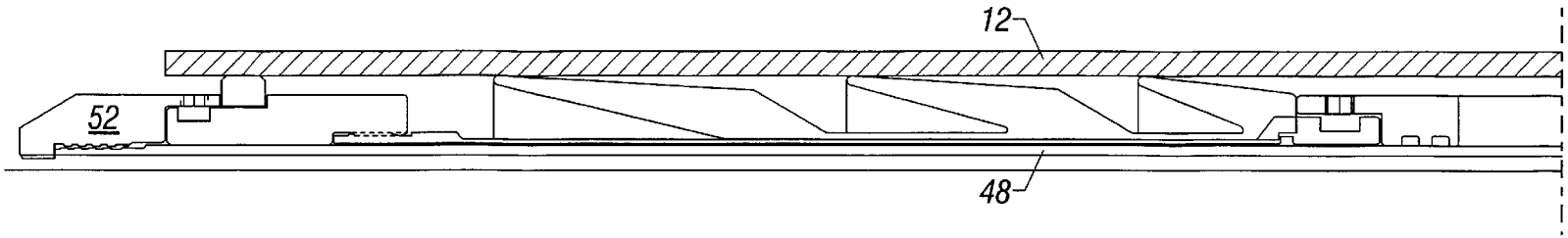
FIGS. 9*a–c* are a sectional elevational view of the pumpable bridge plug while still within the tubing string.
Figure 9B:
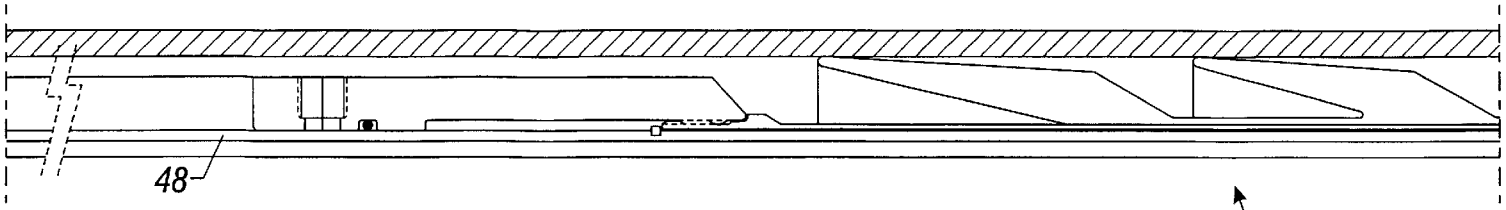
Figure 9C:
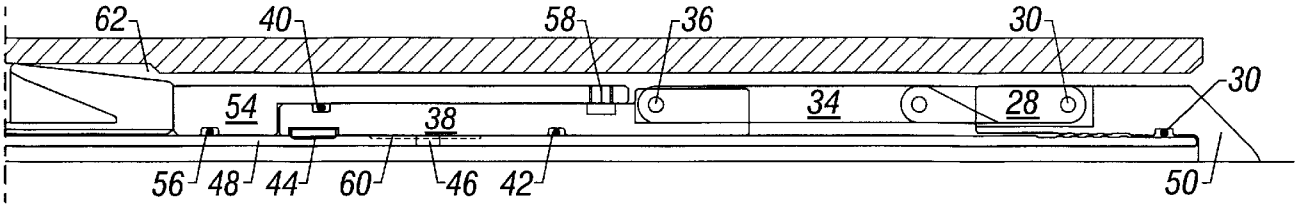

FIGS. 1–8 generally outline the steps in isolating a particular zone in the formation for a fracturing operation. Referring to FIG. 1, the wellbore 10 can be open-hole or cased hole. A tubing string 12, having a packer 14, is inserted into the wellbore 10. Ultimately, as shown in FIG. 6, the packer 14 is actuated, isolating a portion of the annulus 16 from the zone 18, which is to be sand-fractured. In order to define the zone 18, a pumpdown bridge plug 20 is pumped from the surface through the interior bore 22 of the tubing string 12. The bridge plug 20 has an anchor assembly 22, which is shown in more detail in FIG. 10*c,* where the anchoring assembly 22 is actuated for contact with the wellbore 10. The bridge plug 20 has lower wipers 24 and upper wipers 26 of a type well known in the cementing plug art. The bridge plug 20 is shown in more detail in FIGS. 9*a–c* in the run-in position. The anchoring assembly 22 has a link 28 mounted to pivot 30, which is attached to ring 32. Link 34 is mounted to pivot 36, which is attached to piston 38. Piston 38 has seals 40 and 42, as well as a lock ring 44.

Figure 10A:
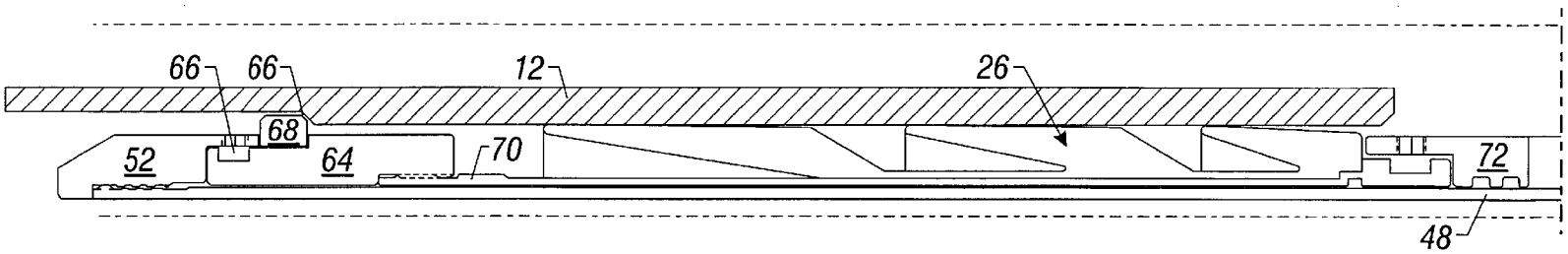
FIGS. 10*a–c* show the pumpable bridge plug anchored.

A port 46 extends through mandrel 48. Mandrel 48 extends from lower sub 50 to top sub 52. Sleeve 54 extends over piston 38, with seal 40 sealing therebetween. Sleeve 54 is sealed against mandrel 48 by seal 56. A shear pin 58 initially holds sleeve 54 to piston 38. Mandrel 48 has grooves or thread 60, which eventually engages the lock ring 44 to hold the set of the anchoring assembly 22, as shown in FIG. 10*c*. Bottom sub 50 has no outlet so that internal pressures applied to the bridge plug 20 transmit a fluid pressure force through port 46, above piston 38, to break shear pin 58. When shear pin 58 breaks, piston 38 moves downwardly to extend links 28 and 34 so that link 34 contacts the wellbore 10, as shown in FIG. 10*c*. To make this happen, the bridge plug 20 is suspended from the tubing string 12 on a shoulder 62. Top sub 52 is engaged to sleeve 64 by shear pin 66. In between top sub 52 and sleeve 64 is split C-ring 68. Thus the bridge plug 20, when pumped down the tubing string 12, comes to a stop when split C-ring 68 engages shoulder 62 on the tubing 12, as shown in FIG. 10*a*.

Once this occurs, pressure is built up in the tubing string 12, which is retained by upper wipers 26. The pressure is transmitted through the mandrel 48 and port 46 to piston 38 to actuate piston 38 downwardly, whereupon its position is locked by virtue of lock ring 44 engaging the threads or wickers 60. A further increase in applied pressure in the tubing string 12 exerts a downward force on sleeve 64. The reason for this is that sleeve 64 is connected to sleeve 70, which underlies the upper wipers 26. Thus, fluid pressure force from the surface through the tubing string 12 applied on the upper wipers 26 urges sleeve 70 downwardly. Sleeve 70 is engaged to upper ring 72, which is connected to a tubular sealing element 74 made from a flexible material so that it can flex, as shown in FIG. 11*b,* into contact with the wellbore 10.

Figure 11A:
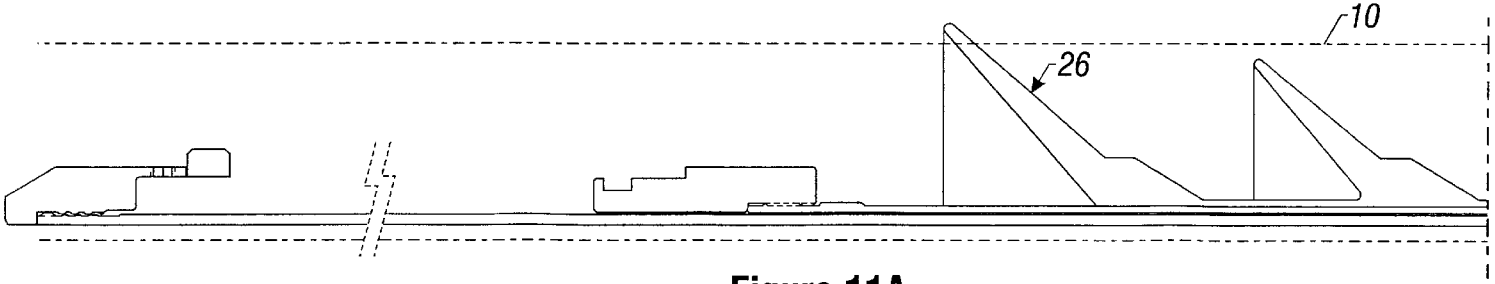
FIGS. 11*a–c* show the bridge plug released from the tubing string and set.
Figure 10B:
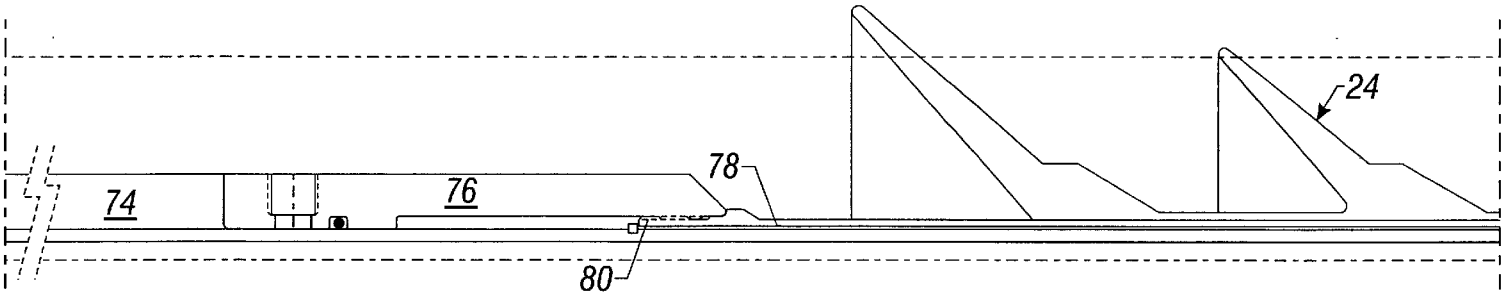
Figure 11B:
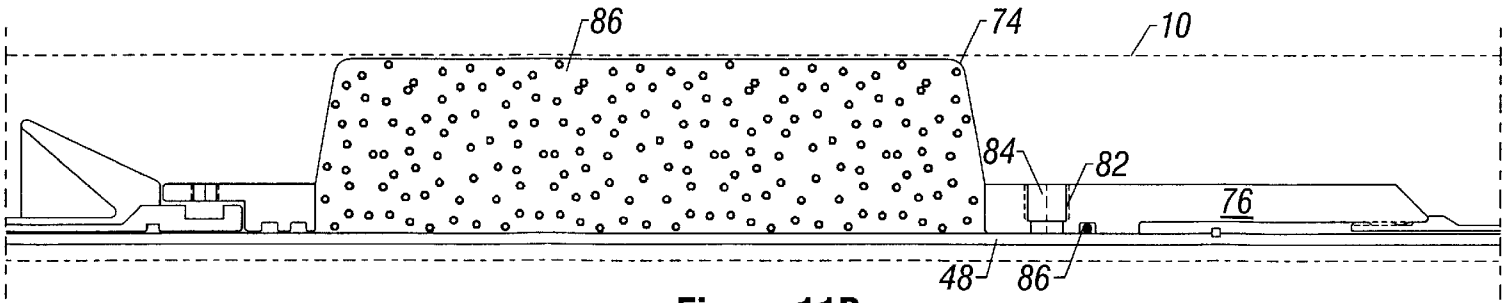
Figure 10C:
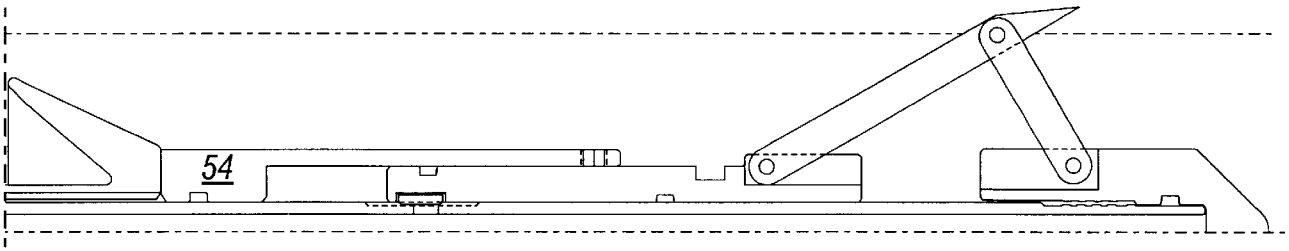
Figure 11C:
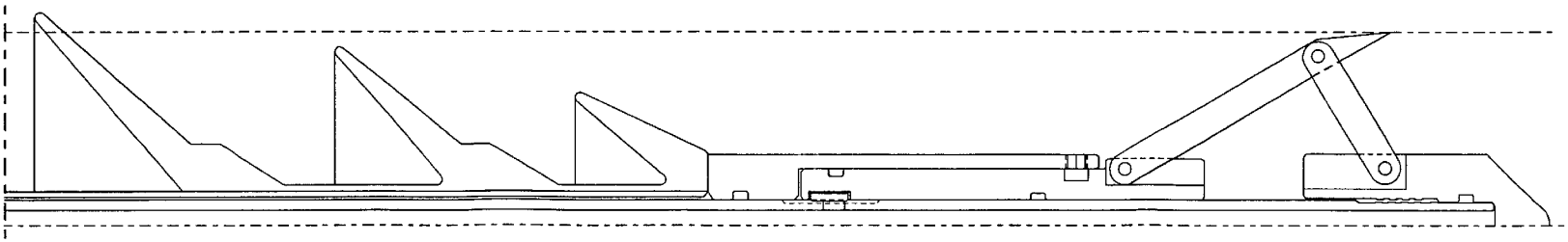

Upper ring 72 rides on mandrel 48, and when shear pin 66 breaks, is free to move relatively with respect to mandrel 48, as shown by comparing FIGS. 10*b* and 11*b*. The sealing element 74 is connected to lower ring 76, which is connected to sleeve 78 at thread 80. Sleeve 78 supports the lower wipers 24. It can be seen that when the piston 38 is driven down, as shown in FIG. 10*c,* that a gap develops between the piston 38 and the sleeve 54. Thus, after the anchoring assembly 22 is set, the sleeve 54 is free to move downwardly until it once again reengages the piston 38. By allowing sleeve 54 room to move downwardly, sleeve 78 can also move down until it again bottoms on sleeve 54. Eventually, the breakage of shear pin 66 frees the bridge plug 20 from the tubing string 12, allowing the tubing string 12 to be picked up from the surface to expose the upper wipers 26 so that they can flex outwardly against the wellbore 10, as shown in FIGS. 11*a* and 11*b*. Applied pressure from the surface acts on upper wipers 26 to move them downwardly, taking with them sleeve 70 and upper ring 72. Lower ring 76 eventually can move no further once sleeve 54 bottoms on piston 38. As a result, upper ring 72 moves closer to lower ring 76, causing the sealing element 74 to change shape as it gets shorter and broader until it contacts the wellbore 10.

The lower ring 76 has a check valve 82, which allows flow outwardly in the direction of arrow 84. Seal 86 seals between lower ring 76 and mandrel 48. Within the sealing element 74 is a particulate mixture 87, preferably as described in U.S. Pat. No. 5,417,285. This mixture contains preferably silica sand in particle sizes between 20 mesh and 200 mesh, coupled with a colloidal clay material such as montmorillonite, and preferably making up approximately 5% by weight of the composition of the material 87.

As a result of the squeezing action of bringing upper ring 72 closer to lower ring 76, the shape of the sealing element 74 is changed until it contacts the wellbore 10. By that point in time, there has not necessarily been an internal volume change in the sealing element 74, but further squeezing from applied pressure at the surface, acting on upper wipers 26, tends to somewhat reduce the interior volume of the sealing element 74 to displace some free water out through check valve 82, as indicated by arrow 84. When this occurs, the aggregate material 87, as described in U.S. Pat. No. 5,417,285, becomes firm to hold the position of the sealing element 74 against the wellbore 10. Those skilled in the art will appreciate that a locking mechanism on sleeve 70 can also be optionally employed similar to lock ring 44 engaging a thread or wicker 60 to hold the set position of FIG. 11*b*. However, the aggregate material 87 inside the sealing element 74 is sufficiently hard so that an upper lock is not mandatory. At this time the bridge plug 20 is set.

Figure 7:
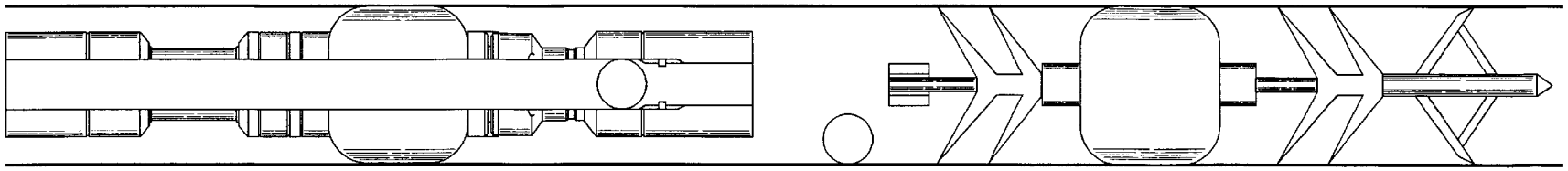
FIG. 7 is the view of FIG. 6, with the ball sheared off its seat so that the fracturing can occur between the bridge plug and the packer on the tool string.
Figure 8:
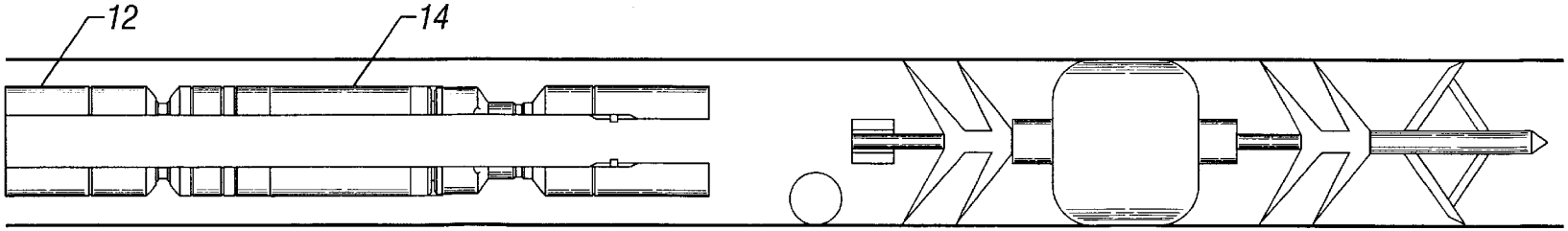
FIG. 8 is the view of FIG. 7, showing the packer on the tool string deflated and ready to be repositioned at a different part in the wellbore for repeating the process.

Referring again to FIGS. 1–8 for an understanding of the complete procedure, the bridge plug 20 is shown being set in FIG. 3, as previously described. Eventually, after shear pin 66 breaks after the anchoring assembly 22 engages the wellbore 10, the position of FIG. 4 is assumed as the tubing string 12 is picked up from the surface, allowing the upper wipers 26 to expand outwardly against the wellbore 10. At that point, as shown in FIG. 5, pressure is applied or, alternatively, setdown weight can be applied, to the bridge plug to change the shape and later the internal volume of sealing element 74 as it contacts the wellbore 10. At this point the bridge plug 20 is set and a ball 88 is dropped on seat 90 and pressure is raised in the tubing 12 to set the packer 14. The ball 88 is then blown through the seat 90, as shown in FIG. 7, and the fracturing operation can then take place. At the conclusion of the fracturing, the packer 14 is deflated by known techniques, such as setting down weight, and the tubing string 12 is repositioned for the next zone up, where the entire procedure described above can be repeated. At the conclusion of the fracturing of all of the zones, the bridge plug or plugs 20 are simply drilled or milled out. Since they are fairly simple structures, they can easily be cut through in a short amount of time to allow for subsequent operations in the wellbore.

It should be noted that it is also within the scope of the invention to use the aggregate montmorillonite-type of mixture, such as described as 87, and more particularly disclosed in U.S. Pat. No. 5,417,285, internally in a variety of plugs or packers used downhole; the advantage being that when such an aggregate material within an element is compressed so that some of the free fluid is displaced, the resulting material is a substantially solid, load-bearing, force-transferring, substantially fluid, impermiable mass which allows the packer or plug to retain differential pressures in a wellbore. This is to be distinguished from U.S. Pat. No. 5,417,285 in that the aggregrate material 87 is inside the sealing element such as 74 as opposed to being supported by an inflatable and above it.

Use of the technique described above is a simple, economical way to sand-fracture a plurality of zones in a given wellbore, using bridge plugs such as 20 that are of economical construction and which can be easily milled through when necessary. While this technique is described with respect to nonretrievable bridge plugs 20, it can easily be adapted to retrievable bridge plugs or packers without departing from the spirit of the invention.

Using the aggregate material 87 within the sealing element 74 allows greater differential pressures to be withstood by the bridge plug 20. Thus, differential pressures of 5,000 psi or more can be tolerated by the bridge plug 20 as compared to prior inflatable designs which do not use the aggregate material 87 and have limits of about 1500 psi.

By placing the aggregate material 87 within the sealing element 74, the bridge plug 20 has bi-directional sealing capabilities from differentials coming from uphole or downhole. The advantage of the system as described above is that by use of bridge plugs 20 that are economical to produce, as well as easy to mill through and which can be quickly delivered to a desired location, a sand-fracturing job in multiple zones in a single trip can be economically accomplished. Additionally, by combining a plug or packer having an aggregate material such as 87 of the type or types as described in U.S. Pat. No. 5,417,285, mounted within the sealing element such as 74, a packer or bridge plug is disclosed that can withstand significantly more differential pressure than prior designs of bridge plugs using simply an inflatable sealing element. While the plug designs described above are amenable for thru-tubing, other types of plugs are within the scope of the invention. Thus, by virtue of a combination of the aggregate material in a sealing element, an improved bridge plug or packer is available for a variety of downhole operations.

The foregoing disclosure and description of the invention are illustrative and explanatory thereof, and various changes in the size, shape and materials, as well as in the details of the illustrated construction, may be made without departing from the spirit of the invention.

We claim:

1. A method of isolating a section of a wellbore, comprising:

providing at least one barrier having a sealing element;

providing within said barrier a material which responds to an applied force by becoming hard;

running said barrier through tubing into the wellbore;

moving the sealing element against the wellbore when said barrier has passed through said tubing;

hardening said material in said sealing element when said sealing element is in contact with the wellbore.

2. A method of isolating a section of a wellbore, comprising:

providing at least one barrier having a sealing element;

providing within said barrier a material which responds to an applied force by becoming hard;

running said barrier into the wellbore;

delivering said barrier through tubing;

moving the sealing element against the wellbore;

hardening said material in said sealing element when said sealing element is in contact with the wellbore;

selectively supporting said barrier with said tubing;

anchoring said barrier in the wellbore while supported by said tubing.

3. The method of claim 2, further comprising:

supporting said sealing element on a mandrel;

applying pressure to said mandrel;

moving a linkage with a piston during said anchoring as a result of said applied pressure.

4. The method of claim 3, further comprising:

releasing said barrier from said tubing;

providing a movable component on said mandrel adjacent said sealing element;

translating said movable component after said releasing;

reducing volume within said sealing element due to said translating.

5. The method of claim 4, further comprising:

providing a wellbore seal on said movable component;

pressurizing through said tubing onto said wellbore seal;

moving said movable component against said sealing element as a result of said pressurizing.

6. The method of claim 5, further comprising:

expelling fluid from within said sealing element as a result of said reducing volume;

hardening said material due to said fluid displacement.

7. A method of isolating a section of a wellbore, comprising:

providing at least one barrier having a sealing element;

providing within said barrier a material which responds to an applied force by becoming hard;

running said barrier into the wellbore;

moving the sealing element against the wellbore;

hardening said material in said sealing element when said sealing element is in contact with the wellbore;

providing a packer on tubing;

setting said packer to provide a second barrier to isolate a zone in the wellbore.

8. The method of claim 7, further comprising:

running in a plurality of said barriers through said tubing;

defining a plurality of isolation zones in the wellbore by a combination of any one of said barriers and said packer on said tubing.

9. The method of claim 8, further comprising:

removing said barriers by drilling or milling.

10. An isolation device for downhole use, comprising:

a mandrel passable through tubing, further comprising an anchoring mechanism for support in the wellbore beyond said tubing;

a sealing element mounted on said mandrel;

a material stored within said sealing element of the type that hardens when it, after said mandrel is supported by said anchoring mechanism in the wellbore beyond said tubing, is subjected to an applied force as said sealing element contacts the wellbore.

11. An isolation device for downhole use, comprising:

a mandrel;

a sealing element mounted on said mandrel;

a material stored within said sealing element of the type that hardens when subjected to an applied force as said sealing element contacts the wellbore;

a releasable latch to allow said mandrel, when passed through tubing, to be engaged by the tubing, with said sealing element extending beyond said tubing.

12. The device of claim 11, wherein:

said mandrel further comprises an upper seal for engagement with the tubing when said mandrel is supported by said latch, said mandrel comprising a passage therein;

said mandrel further comprising a pressure-actuated anchor responsive to pressure in said passage.

13. The device of claim 12, wherein:

said latch releasing from the tubing after a pressure build-up occurs after setting said anchor;

said upper seal mounted on a movable sleeve mounted to said mandrel;

whereupon release of said latch, said upper seal seals against the wellbore, and applied pressure through the tubing moves said sleeve against said sealing element so as to urge said sealing element against the wellbore and compress said material within the sealing element to harden it.

14. The device of claim 13, further comprising:

a passage from within said sealing element to outside said mandrel;

whereupon said movement of said sealing element, fluid is driven from said material as said sealing element is squeezed.

15. A thru-tubing packer for downhole use, comprising:

a mandrel passable through tubing and comprising an anchoring mechanism;

a sealing element;

a material housed within said sealing element which hardens as a result of an applied compressive force;

an actuating mechanism on said mandrel to move said sealing element into contact with the wellbore after said anchoring mechanism supports said mandrel downhole below the tubing, said actuating mechanism hardening the material within said sealing element such that said material retains said sealing element against the wellbore.

16. The packer of claim 15, wherein:

said mandrel comprises a passage leading to said material such that when said sealing element is squeezed, fluid is driven from said material and out through said mandrel as said material hardens.

17. A thru-tubing packer for downhole use, comprising:

a mandrel;

a sealing element;

a material housed within said sealing element which hardens as a result of an applied compressive force;

an actuating mechanism on said mandrel to move said sealing element into contact with the wellbore while at the same time hardening the material within said sealing element such that said material retains said sealing element against the wellbore;

said mandrel comprises a passage leading to said material such that when said sealing element is squeezed, fluid is driven from said material and out through said mandrel as said material hardens;

said mandrel comprises a latch such that when said mandrel is passed through a tubing string, it is releasably retained to the tubing string for placement.

18. The packer of claim 17, further comprising:

a pressure-set anchor mounted to said mandrel;

a movable sleeve with an external seal mounted to said mandrel, said sleeve when in a first position allows pressurization of the tubing, which is sealed by said external seal when said latch engages said tubing, for setting said anchor.

19. The packer of claim 18, wherein:

further pressurization beyond setting said anchor releases said latch to allow said external seal to seal against the wellbore, whereupon applied pressure through the tubing acts on said seal and sleeve and pushes said sleeve against said sealing element to seal the wellbore and to harden said material so as to retain said sealing element against the wellbore.

* * * * *